US006111492A

United States Patent [19]

Fink

[11] Patent Number: 6,111,492

[45] Date of Patent: Aug. 29, 2000

[54] MAGNETIC DRAIN PLUG

[76] Inventor: Randy Fink, 3302 Pine Candle, Spring, Tex. 77388

[21] Appl. No.: 09/374,725

[22] Filed: Aug. 13, 1999

Related U.S. Application Data

[63] Continuation-in-part of application No. 09/052,406, Mar. 31, 1998, Pat. No. 5,949,317.

[51] Int. Cl.[7] ..... H01F 2/02

[52] U.S. Cl. ..... 335/302; 292/251.5

[58] Field of Search ..... 335/302–306; 184/6.21, 6.25; 292/251.5; 210/222

[56] References Cited

U.S. PATENT DOCUMENTS

| | | | |
|---|---|---|---|
| 2,755,932 | 7/1956 | Cohn | 335/302 |
| 4,763,092 | 8/1988 | Tomita | 335/305 |
| 5,420,557 | 5/1995 | Chern | 335/305 |
| 5,465,078 | 11/1995 | Jones, Jr. | 335/306 |

*Primary Examiner*—Lincoln Donovan
*Attorney, Agent, or Firm*—Felsman, Bradley, Vaden, Gunter & Dillon, L.L.P.

[57] ABSTRACT

A magnet set forth used is in a drain plug. A drain plug is assembled with an attached holder securing an inserted cylindrical magnet. The drain plug is formed of non ferrous material such as brass, aluminum, stainless steel, etc. It is constructed in accordance with industry standards to fit as a replacement device in oil drain pans, and is non ferrous material. It incorporates an extending threaded shaft. The holder is constructed with an axial passage there through having threads at the small end for threading through the drain plug. The passage extends fully through the device, interrupted by a transverse internal registration shoulder at the middle, and defines an extending skirt fitting loosely around an elongate cylindrical rare earth magnet. Also, a dipstick mounted version for small engines is shown and places the magnet on the dipstick in a magnet holder.

14 Claims, 2 Drawing Sheets

MAGNETIC DRAIN PLUG

BACKGROUND OF THE DISCLOSURE

This application is a continuation in part of application Ser. No. 09/052,406 which was filed on Mar. 31, 1998 now U.S. Pat. No. 5,949,314.

The present disclosure is directed to a magnetic drain plug, and especially one which is installed in the oil pan of a automotive engine equipped with a crank case. The crank case is normally filled with lubricating oil. Lubricating oil is provided to lubricate the high speed operation of the crank shaft and piston rods which connect with it. In very general terms, substantial friction is created in this area The friction is reduced by filling the crank case with lubricating oil. In turn, the lubricating oil protects the rotating equipment.

There is the risk of metal particles being formed by the equipment. Abrasion and friction form particles which collect in the crank case. These particles can be cycled with the oil time and time again through the bearings and thereby damage the bearings. It is known to remove the particles with a filter. Sometimes, the flow lines in the crank case area do not direct all the oil through the filter. Rather, the metal particles fall out and collect in the oil pan thereby creating damages. Damage commonly is noted in the cylinder walls and seal rings. U.S. Pat. Nos. 5,465,078 and also 5,634,755 are pertinent to this inquiry. The '078 patent shows a magnetic drain bolt. It includes a bolt body with a magnet. This is one approach to collecting the small metal particles. Another device is the '755 patent just mentioned. It shows a bolt body with a magnet placed in it. Both of these represent devices which have met with measured success. There are limitations to them. Among the limitations, there is the spreading of the magnetic flux lines. In general terms, for a magnet of a specified or given strength, the magnetic flux lines extend outwardly from the magnet. The distribution of these flux lines in the immediate region is determined in part by the nature of the metals which support the magnet. The magnet in the references is held by a separable bolt. There is no recognition in the two references that the flux lines need to be dealt with least wide area distribution of the flux lines creates an effective magnet which is wider in size but which is reduced in intensity. The size of the magnet is enhanced as the flux lines are spread in the immediate region. In part, this depends on the magnetic response of the metal used to fabricate the bolt. In general terms, if a ferrous metal is used, it is relatively easily magnetized. The response of ferrous metal used in the bolt body and the construction of the oil pan causes a wider distribution of the magnetic flux. That however is not an advantage as will be noted below.

The flow velocity at the point of installation in the crank case may dislodge magnetically attracted particles. They will be dislodged by the high speed of the flow. Moreover they will be held in a wider region adjacent to the prior art devices just mentioned. Specifically some particles may be drawn to the bolt head and others to the magnet. However, some magnetic particles may fall through an eddy in the flowing oil and settle out, held magnetically next to the removable drain plug. Particles held magnetically to the oil pan are hard to remove. Periodically the engine lubricating oil is drained. This done by removing the plug. The metal particles on the plug can be wiped from the plug thereby removing them from the crank case. In the instance where fluid flow velocities are great in the crank case, the particles may be knocked loose from the bolt head, flushed around the crank case, and ultimately dropped out by eddy velocities and will be held by the magnetized region of the oil pan. When the bolt is removed and cleaned, some but not all of the particles will be removed. This is clearly the inference in the '078 patent as shown in the drawings and is tacitly the net result accomplished also in the '755 structure noting FIG. 8 thereof.

The apparatus of the present disclosure provides a magnet which is held higher in the region of oil flow. It is exposed to the oil flowing above the oil pan. It is also exposed to the oil at a higher elevation in the crank case. This location has an advantage and a comparable disadvantage. One advantage is that the magnet is exposed to substantially all the oil in the crank case because it flows by with significant scavenging velocity to thereby pick up particles and circulate them in near proximity to the magnet. This increases the likelihood that a metal particle will pass by and thereby be held by the magnet. In this region there is less likelihood that particles flowing by will be caught on the magnetism otherwise found in the distributed areas of the oil pan near the drain plug. This arrangement enhances the scavenging of this approach. It is accomplished however at a cost, namely, that it is closer to the rotating equipment and the flow velocities in the lubricant are more universal. With greater velocities, the likelihood of sweeping off previously collected particles increases. To counter this, the magnet of the present invention has a greater magnetic force. The force of the magnet is normally measured in units of strength known as oersteds.

It has been determined that the magnetic strength is optimum using a magnet sold under the Model TRI-NEO 30. This is a rare earth material magnet provided by Tridus International. It is made of a mixture of neodymium-iron boron. Other rare earth permanent magnets of comparable strength are acceptable. At temperatures common to those encountered in a crank case, this rare earth magnet provides permanent magnetic attraction which is better than ceramic or alnico (aluminum, nickel and cobalt) magnets. This is a sintered material which is shaped into an appropriate form. In this particular instance the form is preferably an elongate cylinder. Roughly, the sintered form of the magnetic material (generally the rare earth magnets) has very good magnetic strength at temperatures above about 100° C. and are therefore quite acceptable in this environment. Even where the crank case temperature is maintained higher, it is not normally raised much above 120° C. because excessive temperatures damage lubricating oils. Moreover, operation in the lubrication oil prevents corrosion on the surface. In that sense, corrosion and surface damage to the magnet is reduced or even prevented. In general terms it is able to provide about four to six times the energy product of the above mentioned alnico magnets. In general terms the alnico magnets define the standard; the rare earth magnets of this disclosure will operate at the appropriate temperatures and conditions.

The present disclosure is summarized as a three part system. The visible part is the removable crank case plug. The preferred materials are ceramics or metals which have minimal ferrous content and which are therefore not readily magnetized. Dependent on machining requirements, typical metals include aluminum, brass, copper, stainless steel, and others which essentially allow permeability of about 1.000. The bolt is constructed with a threaded connector. The bolt itself may vary depending on SAE standards for that particular vehicle. In some instances, metric measurements may be involved and the thread profile may be specified. Without regard to all of that, the bolt is made in accordance with these SAE standards and is the mounting device which supports the remaining two components.

The second component is a cup which serves as a holding device. The cup is attached by threading to the bolt. The cup is uniform in size and shape. The cup or holder is equipped with a drilled receptacle to receive a rare earth magnet of cylindrical form. The cylindrical shape is uniform from model to model. This reduces inventory requirements. Moreover the bolt is made of nonferrous material so that the bolt body does not spread the magnetic flux lines and thereby magnetize everything in the immediate vicinity. In effect, this creates a more concentrated magnetic field to pick up particles flowing nearby.

ENHANCED FEATURES IMPROVING METAL PARTICLE SCAVENGING

There are a number of internal combustion engines which can benefit from protection. Consider a golf course mowing machine. Typically, it will have an upstanding dipstick into the crank case. It may not always have a crank case drain plug. Many motorcycles are made without a crank case drain plug or it is not located where effective particle scavenging occurs. Motorcycles, small horse power engines, tractor engines and the like may provide better access for scavenging the oil by installing the present apparatus on the dipstick. The dipstick mounting typically locates the dipstick so that it points downwardly and into the pool of oil in the crank case. The geometry of a typical automotive crank case lends itself to a central drain plug. That is not always the case with this sort of smaller engine. For instance, the crank case with a typical motorcycle permits draining of spent lubricating oil, but the drain plug is not located sufficiently close to the operating equipment to scavenge particles. Sometime, because of space constraints, the drain plug itself will be relatively shallow, i.e., not very tall, and the rotating crank shaft in the crank case will move so close that there is almost no clearance. In other instances, the crank case may be screened with a baffle plate internally located to assure constraint of the splashed lubricating oil. Sometimes, the baffle plate solves one problem but creates another problem for this equipment, namely, it will screen off the region of the crank case plug. For these and many other reasons, attaching the present apparatus to the drain plug may work in many instances, but may not work in other instances all dependent on the crank case geometry and other factors involved.

With that in view, the present disclosure sets forth a modified embodiment. This embodiment adds a dipstick version. In addition to that, another embodiment provides added seal protection. It is desirable that the equipment be mounted in the crank case. Lubrication in that area is essential. If that becomes dry as a result of leakage, the engine can be destroyed completely. This risk arises from leakage. In one aspect, the present disclosure incorporates a leakage protection system utilizing a lock washer and gasket ring. This assures that leakage out of the crank case will not occur.

The enhanced features of the present disclosure have been addressed in general terms above and it is believed that they are an appropriate advancement over the disclosed and claimed aspect of the parent patent of this disclosure.

BRIEF DESCRIPTION OF THE DRAWINGS

So that the manner in which the above recited features, advantages and objects of the present invention are attained can be understood in detail, more particular description of the invention, briefly summarized above, may be had by reference to the embodiments thereof which are illustrated in the appended drawings.

It is to be noted, however, that the appended drawings illustrate only typical embodiments of the invention and are therefore not to be considered limiting of its scope, for the invention may admit to other equally effective embodiments.

DETAILED DESCRIPTION OF THE PREFERRED EMBODIMENT

Figure 1:
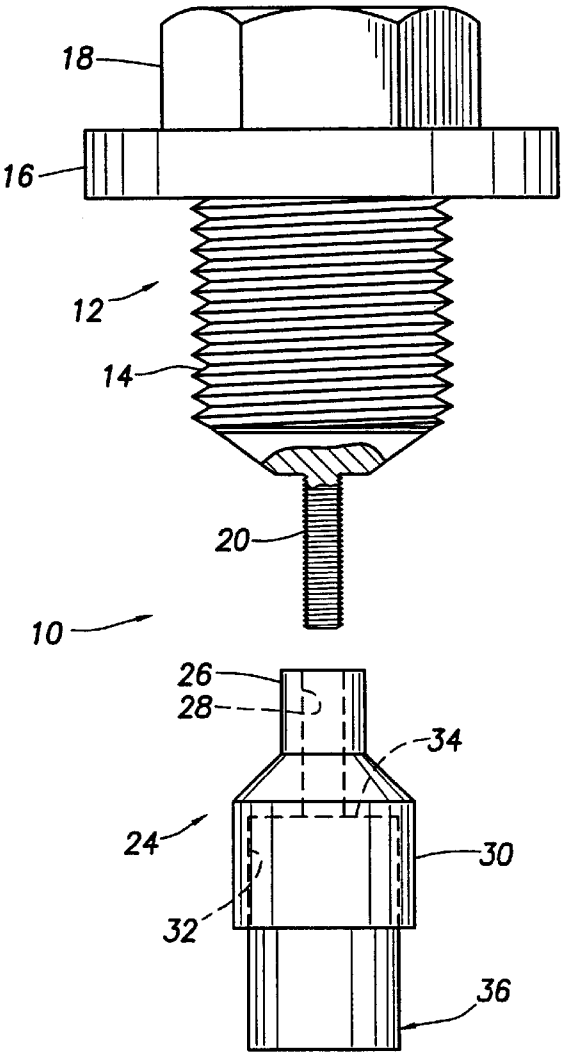
FIG. 1 shows the preferred embodiment of the present disclosure including a drain plug, a threaded cup holder, and cylindrical magnet.

Attention is directed first to FIG. 1 of the drawings. In that view, the entire assembly is shown and is identified by the numeral 10. Beginning however from the top of FIG. 1, a drain plug 12 is shown. The drain plug incorporates a threaded body 14 which is provided with threads of the appropriate thread size and body diameter to thread into an oil pan. The threads and the length of the body are determined by SAE standards. The number of turns of threads is sufficient to enable a tight grip to be obtained and to shoulder up the surrounding flange 16. A bolt head 18 is included to unthread the drain plug 12. In the preferred structure it is made of stainless steel that has a reduced magnetic susceptibility. It is not easily magnetized. Moreover it is chosen for structural stability and ease of machining. There are other materials which are easily machined. An example is a drain plus formed of ceramics or other composite materials. So long as they can be shaped and hold their shape and provide adequate strength, they are generally sufficient for these purposes. The primary goals are the provision of a drain plug which can be threaded and unthreaded time and again in the process of providing lubrication service to the vehicle. This service inflicts modest wear and tear to the drain plug 12. Sometimes, a flat gasket or seal ring is necessary adjacent to the flange 16. As appropriate, and in accordance with SAE standards, the flange is shaped to accommodate that also.

The plug 12 has the body 14, flange 16 and bolt head 18 which are all defined in size, shape and thread shape in accordance with SAE standards. The bolt body 14 supports a threaded shaft 20. It serves as a connector. The shaft 20 therefore has a specified length. This will enable it to thread to the cooperative equipment. In addition, the shaft 20 has a specified thread system on it so that there is compatibility as will be detailed. FIG. 1 shows the cup holder 24. The cup holder is constructed with a centered cylindrical body portion 26. The interior is drilled with a hole 28 and threads are formed in that hole 28 to match the threads on the connector 20. The length of the hole 28 compared with the threaded shaft 20 will be noted. A larger cylindrical portion 30 is at the lower end. It is formed with a cylindrical opening at 32. That is a smooth wall terminating at a smooth transverse shoulder 34. The entire cup holder 24 is hollow through its centerline axis. It is hollow so that a plunger can be inserted through the hole 24 to push the cylindrical magnet out of the cup holder 24.

The system also includes an elongate cylindrical magnet formed of sintered rare earth materials. This is identified at 36. The preferred form uses the above mentioned neodymium-iron boron (Nd-Fe-B) system. Preferably the magnet has about 20 oersteds or greater field strength. The magnet 36 is typically about one-quarter to one-half inch in diameter. The length varies from about 0.5 to about 1.5 inches. Larger models can be made for larger vehicles. However, one size will normally suffice for most engines. Sizes of the components should be noted. The cylindrical magnet body 36 is preferably finished and coated with a smooth external surface. This can have the form of a metal coating, or any type of acceptable spray on plastic coating including PTFE plastic systems can be applied. The purpose of the coating is to reduce surface corrosion and to provide a relatively smooth surface so that the cylindrical magnet can be cleaned. It is inserted into the cup holder 24 and shouldered against the end of the shoulder 34. A tight fit is not needed. A suitable clearance in the cup holder of about 0.002 or greater is sufficient. That kind of clearance will enable the cylindrical magnet to be inserted into the cup holder. The cup holder covers over the exterior of about 35 to 65% of the magnet. While no specific ratio is mandated, it is desirable that the magnet be snugly fitted so that it does not drop out and is not otherwise released.

The cup holder 24 is preferably made of selected grades of metal. It is easier to machine with more carbon in it. A suitable machining metal stock is 4140 steel. By using that, magnetic lines of flux from one end of the magnetized cylinder will emerge and be distributed through the steel of the cup holder. That is not particularly a detriment because the surface area of the cup holder is not much greater than the surface area of the magnet body 36. In other words, the thickness is not significantly increased and the length is not substantially altered. The free or exposed end of the magnet is the end protruding to the greatest extent into the oil bath in the crank case. The covered end which is in the cup holder 24 is less likely to attract metal particles during the flow of lubricant around the device when installed. In that light, the system is installed so that most metal particles will magnetically attach to the cylindrical magnet 36. The open cylindrical end of the cup holder is cylindrical; in one form, it can be partially split into two or four segments to make insertion easier. This also reduces flux linkage.

The passage 28 has a length which is slightly greater than the exposed shaft 20 which serves as a connector. This assures that the threaded shaft 20 does not bump or otherwise upset the cylindrical magnetic body received in the cup holder. This assures appropriate seating without dislodging the magnet. Yet, the hole 28 is kept open prior to installation so that the magnet can be seated or removed.

Removal is easily done by inserting a push rod through the opening 28 to dislodge and remove the cup holder from the magnet. In general terms, that is not needed very often.

Figure 2:
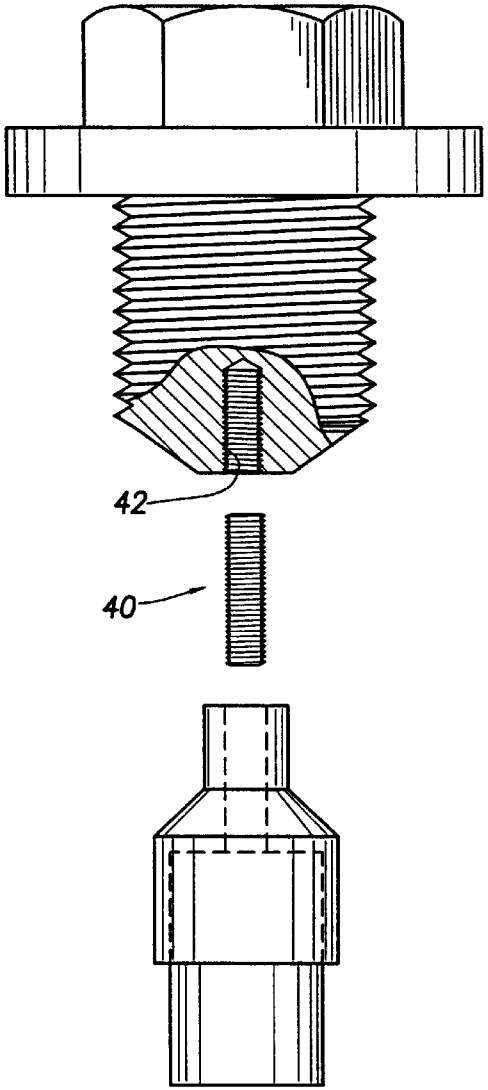
FIG. 2 shows an alternate embodiment utilizing a different threading system for connection of the components.

FIG. 2 is different from the structure of FIG. 1 in that the threaded connector 20 is shown as a separate component. Depending on the ease of machining and the type of materials that are involved, the drain plug in FIG. 2 can be made separate from the threaded connector 20. In that event, the connector 40 threads in the passage 42. The system shown in FIG. 2 ultimately involves four pieces while the system shown in FIG. 1 involves only three pieces. In that sense, it is easier to assemble and is easier to install. The male and female threads (see shaft 20 or 40) are aided by an epoxy resin to lock the threads after assembly. If desired, the resin can be put in the female opening in place of the threads to adhesively join the members during assembly.

ASSEMBLY AND INSTALLATION OF THE DEVICE

Whether the embodiment of FIGS. 1 or 2 is used, the device is assembled with a drain plug that is built in accordance with SAE standards for a particular vehicle. This mandates installation of appropriate gaskets to prevent leakage. This also involves the unthreading of the device so that it can be removed and installed thereafter. Removal and installation is accomplished in the ordinary fashion. In that sense, the device is installed as any drain plug in an automobile. In a retrofit situation, the drain plug 10 is installed by first removing the stock drain plug prior to substituting this apparatus. This apparatus is assembled by first pressing the cylindrical magnetic 36 into the receptacle provided for it until it shoulders against the transverse wall 34. That type construction and assembly is carried out simply by pushing the cylinder into the receptacle. Clearance is provided because a tight fit is not needed. The two components are held together by magnetic attraction. This is done to put the components together and then the shaft 20 is threaded into the mating receptacle. The plug for the particular vehicle is sized in accordance with SAE standards. That governs the width of the flange 16, the length of the threaded body 14 and the particular threads on the body. The head 18 is normally provided with a single profile or shape, again determined by industry standards. In that circumstance, the entire assembly is then installed. Typically, this occurs after draining the crank case and removing all of the oil. The plug is put into the crank case. The crank case is refilled with oil. After refilling, the oil added surrounds the magnet completely. During operation for an interval, trash is picked up and is held on the magnet. In general terms, it is not held on the plug. Moreover, it is not held by the oil pan. Trash is located above the pan. It is high up in the oil flow. In that region, it is less likely to be attracted to the oil pan. More importantly, a magnetic circuit is not formed which otherwise would extend to the oil pan through the drain plug 12 were it made of ferrous material. In summation, the device is more effective to attract and hold metal cuttings and trash. The trash and cuttings are more easily removed. Easy removal is accomplished because the cutting cling to the cylindrical magnet 36. They do not commonly stick to the plug 12. This improved servicing in that trash and particles are removed more readily.

Periodically, the vehicle can be re serviced by draining the crank case. When that is done, the plug 10 again is removed. The improved crank case drain plug of this disclosure brings the metal shavings out in a better organized fashion. It is less likely to leave particles magnetically adherent to the inside of the crank case. It is desirable that this procedure be done on scheduled oil changes.

The device of the present invention was tested. A vehicle was selected which had received periodic maintenance. The periodic maintenance is listed in the attached chart which has entries for the date and mileage of the oil changes in the columns below. This conventional vehicle equipped with a conventional drain plug was serviced in the regular manner for all entries but the last two entries. Then, this novel device was installed. Even though it was installed in a crank case filled with fresh and presumably clean oil, it was able to pick up a number of metal shavings. The chart below identifies the dates on which this device was removed and service provided. Moreover, the device was installed at 65972 miles and then cleaned only 860 miles later, trash was removed. The trash collected was comprised of metal filings. The metal particles were larger and some were smaller. This indicates that a number of metal filings had collected in the oil pan and were not quarantined there before. The free floating particles pose a serious problem. It means that the particles stay in the crank case and are not necessarily removed after being pumped by the oil pump system through the positive pressure filter. Problems arise because particles are hard to capture. This device was able to capture the small metal particles. They were caught magnetically on the magnet 36. They did not collect on the drain plug 12. They attached preferentially to the exposed area of the cylindrical magnet 36.

This apparatus is able to remove metal shavings and particles even when the crank case oil system is protected by a filter system. Only the magnet gets and holds them permanently. Indeed, the most difficult aspect of this device is the difficulty in removing the metal shavings from the cylindrical plug 36.

DIPSTICK MOUNTED INSERT

Figure 3:
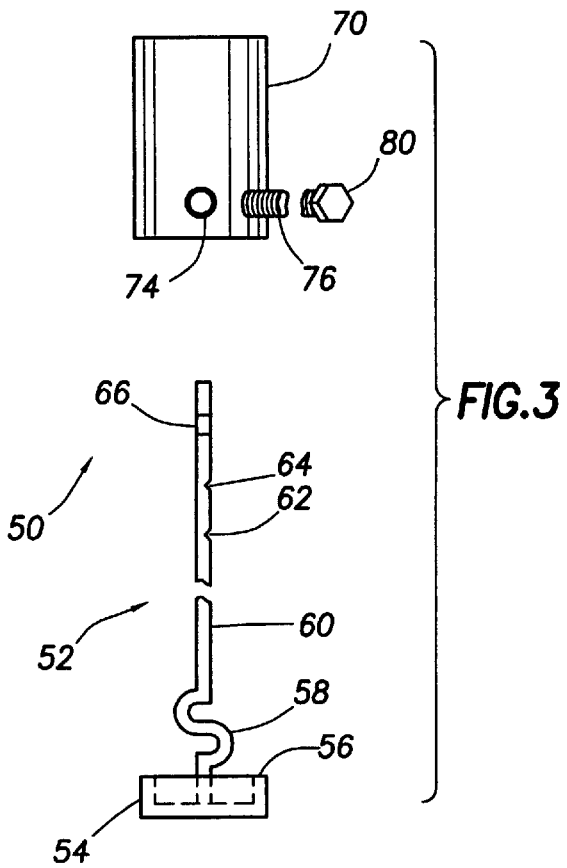
FIG. 3 is a side view of a dipstick with an adapter appended to the end of the dipstick.

Attention is directed to FIG. 3 of the drawings where the numeral 50 identifies a modified version of the present apparatus. It has been drawn with a dipstick illustrated in reduced scale. The dipstick 52 cooperates with the attachment shown in FIG. 3 as will be explained. The dipstick is involved in a dipstick measuring mechanism and normally is located on the top end of an extending pipe. The dipstick is constructed with a cap 54 having surrounding lip 56 which reaches over the pipe. This helps center and align the dipstick. There is an elongate metal wand 60 which is typically folded at 58. The wand has a sufficient length to enable it to extend into the pool of lubricant accumulated in the crank case. The long wand 60 has been illustrated to take out the central length. It can be very long. It can be very short also. It can be straight or bent, as needed. The dipstick is constructed with a mark creased or grooved across the dipstick. The line 62 is the line indicating that the amount of oil is adequate. The line 64 is spaced from it so that they define an acceptable range of lubricant in the crank case. So long as the lubricant strikes a level between the lines 62 and 64, there is enough for operation. If the dipstick does not find any oil or provides a zone closer to the tip, then it is a sign that oil must be added. The lubricating oil is added to bring the level somewhere in the range between the lines 62 and 64. In this disclosure, the dipstick has a perforation in it at 66. The perforation 66 cooperates with a magnet holder 70. The holder 70 is axially hollow to support a rare earth magnet 72 better shown in FIG. 4. The magnet holder 70 is provided with a threaded or tapped opening 74, and a threaded bolt 76 is placed in the threaded opening 74 and threads to it. In the preferred embodiment, the threaded bolt 76 has a head 80 cooperating to lock the magnet holder 70.

Figure 4:
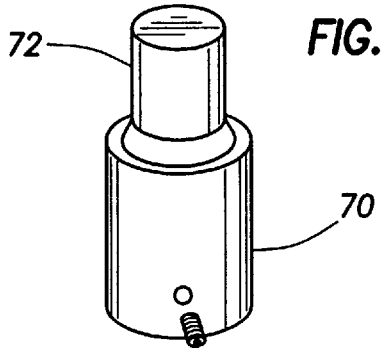
FIG. 4 is a view similar to FIG. 3 showing the mounting of the magnet for the dipstick.
Figure 4A:
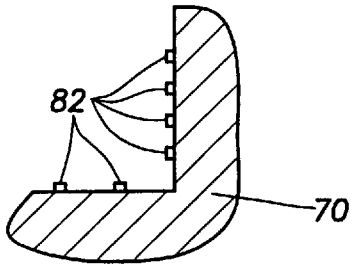
FIG. 4A is an enlarged detail in section.

FIG. 4 shows the magnet 72 in position for insertion into the holder 70. Typically, it is pressed into this container. In the preferred embodiment, the magnet 72 can be pressed into the magnet holder 70. In one form, the magnet holder can be made of material which responds somewhat to magnetism. Nevertheless, that is not the sole method of holding the magnet 72 in the magnet holder 70. FIG. 4A shows a broken view in section and further illustrates how the magnet is held in place. The numeral 82 identifies a set of raised knurled lines. They need not extend very far and can have a height typically of just a few thousandths of an inch. Accordingly, the magnet holder 70 in this instance can be a plastic body having the pre-formed knurled lines so that the magnet is frictionally gripped. This places very little loading stresses on the magnet so that it is not damaged structurally by gripping.

In the forgoing description, the dipstick is modified by the formation of the hole 66 through it which matches the bolt 76. They are bolted together for securing the magnet holder 70 on the end of the dipstick. The dipstick is then placed in the crank case to locate and position the magnet at an elevation likely to scavenge metal particles churned in the lubricating oil.

Typically, the wand 60 will formed of steel. In the preferred embodiment, the bolt 76 is preferably formed of brass or some other non magnetic material. The magnet holder 70 in this instance is then constructed of either brass or plastic. By using a plastic which is sufficiently resistant to the operating temperatures, it will provided more than adequate life. Also, the plastic magnet holder is especially effective in reducing cost on the one hand, and yet providing an adequate grip. The grip, no longer assisted by the magnetic attraction, is achieved by forcing the magnet 72 into the opening with a friction fit. Caution is exercised to avoid placing excessive hoop stresses as a result of the force fit which is accomplished in the system. Because the hoop stresses are minimal, the magnet 72 is not placed in jeopardy. Better than that, it is held in place by the serrations or knurled raised ridges 82 in contact with the magnet.

Figure 5:
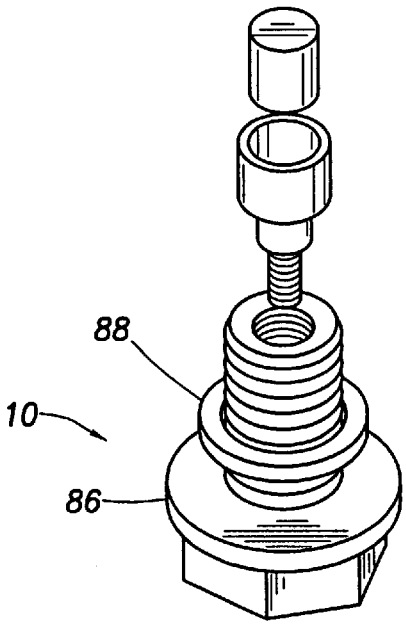
FIG. 5 shows a washer and gasket cooperating with the protected drain plug of the present disclosure.

Attention is now directed to FIG. 5 of the drawings. FIG. 5 offers an additional enhancement to the structure 10 shown in FIG. 1. That is again indicated in general terms by the reference numeral 10. It is modified by the incorporation of a washer 86 cooperative with a gasket ring 88. Pressure applied on tightening the drain plug applies a force to the gasket 88 for sealing purposes. The device operates in the same fashion as previously described.

One important benefit of the present system is the adaptability of crank cases of a different construction. Another aspect of it is adaptability for the expressed purpose of protecting engines configured other than a conventional automotive engine. Automotive engines have the luxury of a very large oil pan that is relatively deep so that substantial quantities of lubricant are in the pan. It is not uncommon to construct an automotive engine holding four or five quarts of lubricant. The embodiment 50 by contrast is often used in a motorcycle work lawn equipment and the like, which may hold only two quarts of lubricant. In the latter situation, the protection is all the more significant and must be accomplished more rapidly to assure that the metal particles do not create serious difficulties by grinding on the other surfaces.

While the foregoing is directed to the preferred embodiment, the scope thereof is determined by the claims which follow.

CHART

| DATE | ODOMETER | OIL CHANGED |
|---|---|---|
| 2/15/95 | 3537 | YES |
| 6/29/95 | 11542 | YES |
| 10/03/95 | 17310 | YES |
| 11/18/95 | 21117 | YES |
| 12/29/95 | 23601 | YES |
| 2/09/96 | 26300 | YES |
| 3/22/96 | 29150 | YES |
| 5/10/96 | 32480 | YES |
| 6/15/96 | 35244 | YES |
| 8/17/96 | 37570 | YES |
| 9/28/96 | 39793 | YES |
| 11/10/96 | 42273 | YES |
| 12/07/96 | 43976 | YES |
| 2/01/97 | 47083 | YES |
| 3/20/97 | 49411 | YES |
| 5/03/97 | 52403 | YES |
| 6/26/97 | 55544 | YES |
| 9/13/97 | 59138 | YES |
| 10/16/97 | 61185 | YES |
| 11/21/97 | 63020 | YES |
| 1/15/98 | 65490 | YES |
| 2/07/98 | 65972 | YES |
| 2/24/98 | 66832 | YES |

What is claimed is:

1. A drain closure device for an automotive engine equipped with a crank case and an oil pan and having a drain hole therein and comprising:

(a) a drain plug constructed in accordance with industry standards having a threaded body to enable threading into the oil pan at the drain hole, and also including a tool engaged head on said body so that said plug closes the drain hole wherein said drain plug is a non ferrous material, the drain plus defining a female threaded receiver at an end of the drain plug opposite the head;

(b) a magnet holder having a receiving chamber defined by a magnet contacting wall in said chamber, the holder defining a mating male threaded bolt integrally formed with the holder, the male threaded bolt adapted to connect the holder to said drain plug and wherein said drain plug and holder together jointly mount a magnet; and (c) a rare earth magnet in said holder receiving chamber wherein said magnet is held within said magnet holder and protrudes therefrom into oil within the crank case and is positioned so that magnetic lines of flux above a certain strength interact with metal particles in the oil confined in the crank case to pick up such metal particles, and wherein said magnet forms lines of flux extending into the crank case to attract and thereby to remove metal particles from the oil, and wherein said magnet is magnetically isolated from said oil pan and wherein said magnet is held within said holder by friction using knurled ridges within said chamber of said holder.

2. The apparatus of claim 1 wherein said holder comprises:

(a) an elongate cylindrical upper portion defining the receiving chamber;

(b) a concentric elongate solid cylindrical lower portion wherein said upper and lower portions are integrally formed;

(c) wherein said passage extends along said holder a sufficient length to define the receiving chamber, and said passage is sized in said upper portion to receive said magnet therein;

(d) wherein the lower portion is contiguous to and integrally formed with the mating male threaded bolt.

3. The apparatus of claim 2 wherein said drain plug is constructed in accordance with industry standards to incorporate a protruding flange around said tool engaged head, and further wherein said head and flange are on the exterior of said oil pan; and wherein said magnet extends from the installed drain plug so that the magnetic lines of flux from said magnet are primarily in the oil within said oil pan.

4. The apparatus of claim 3 wherein said magnet is a rare earth material magnet formed as sintered particles shaped into an elongate cylindrical body.

5. The apparatus of claim 1 wherein said holder is an elongate axial hollow member having an enlarged surrounding skirt adjacent to a transverse shoulder so that said shoulder provides a registration surface limiting movement of said magnet at installation.

6. The apparatus of claim 1 wherein said magnet comprises an elongate cylindrical insert received in said holder, and said holder frictionally fits around said magnet to enable insertion and removal of the magnet from said holder.

7. The apparatus of claim 1 wherein said drain plug head is integral with a surrounding shoulder face having an area for contact with a surrounding gasket, and wherein said magnet is removably held within said holder.

8. The apparatus of claim 7 wherein said drain plug head and said magnet holder join at an extending shaft positioned in a mating hole.

9. The apparatus of claim 1 wherein said magnet is coated with a material forming a smooth exterior surface to reduce corrosion of the magnet and to aid in cleaning the magnet.

10. A closure device for an engine equipped with a crank case and an oil pan and having a access opening therein, the closure device comprising:

(a) a removably attached capping element for closing said access opening;

(b) a magnet holder having a receiving chamber defined by a magnet contacting wall in said chamber wherein said holder is connected to said capping element wherein said capping element and holder together jointly mount a magnet; and (c) a rare earth magnet in said holder receiving chamber wherein said magnet is held within said magnet holder and protrudes therefrom into oil within the crank case and is positioned so that magnetic lines of flux above a certain strength interact with metal particles in the oil confined in the crank case to pick up such metal particles, and (i) wherein said magnet forms lines of flux extending into the crank case to remove metal particles from said oil, and (ii) wherein said magnet is held within said holder by friction with knurled raised ridges within said chamber in said holder into which said magnet is removably inserted.

11. The closure device of claim 10 wherein:

(a) said access opening comprises a drain hole in said oil pan;

(b) said capping device comprises a drain plug constructed in accordance with industry standards having a threaded body to enable threading into the oil pan at the drain hole, and also including a tool engaged head on said body so that said plug closes the drain hole wherein said drain plug is a non ferrous material; and (c) said magnet is magnetically isolated from said oil pan.

12. The closure device of claim 10 wherein:

(a) said access opening comprises a dipstick opening into said crank case; and (b) said capping device comprises a capped dip stick to enable dipping into the crank case to measure a level of said oil and also including a cap on said dipstick so that said cap closes said dipstick opening;

(c) said magnet holder is attached to said dipstick and protrudes therefrom into said oil within said crank case so that said magnet within said holder forms lines of flux extending into said oil within said crank case to remove metal particles therefrom; and (d) said magnet is magnetically isolated from said oil pan.

13. The closure device of claim 10 wherein said magnet is a rare earth material formed as sintered particles shaped into an elongated cylindrical body.

14. The closure device of claim 10 wherein said magnet has a strength of at least 20 oersteds.

* * * * *